US008943975B2

(12) United States Patent
Gmeinwieser et al.

(10) Patent No.: US 8,943,975 B2
(45) Date of Patent: Feb. 3, 2015

(54) ROLLER COASTER RIDE ELEMENT WITH MOVEMENT IN A SECOND DRIVING DIRECTION

(75) Inventors: Roland Gmeinwieser, Offenberg (DE); Walter Steininger, Offenberg (DE); Rupert Koeckeis, Schoenberg (DE)

(73) Assignee: Zierer Karussell-und Spezialmaschinenbau GmbH, Deggendorf (DE)

( * ) Notice: Subject to any disclaimer, the term of this patent is extended or adjusted under 35 U.S.C. 154(b) by 113 days.

(21) Appl. No.: 13/533,892

(22) Filed: Jun. 26, 2012

(65) Prior Publication Data

US 2013/0019771 A1 Jan. 24, 2013

(30) Foreign Application Priority Data

Jun. 27, 2011 (EP) ..... 11171472

(51) Int. Cl.
*A63G 7/00* (2006.01)
*A63G 31/00* (2006.01)
*A63G 21/00* (2006.01)

(52) U.S. Cl.
CPC *A63G 7/00* (2013.01); *A63G 21/00* (2013.01); *A63G 31/00* (2013.01)
USPC ..... 104/53; 104/63

(58) Field of Classification Search
CPC ..... A63G 7/00; A63G 1/00; A63G 31/00; A63G 21/04; A63G 21/06; A63G 21/10; A63G 2031/00; A63G 2031/002
USPC ..... 104/127, 128, 129, 53, 54, 67, 9, 82, 104/86, 85, 63; 472/131, 43
See application file for complete search history.

(56) References Cited

U.S. PATENT DOCUMENTS

| | | | | |
|---|---|---|---|---|
| 6,941,872 | B2 * | 9/2005 | Roodenburg et al. | 104/53 |
| 7,484,460 | B2 * | 2/2009 | Blum et al. | 104/53 |
| 7,584,704 | B2 * | 9/2009 | Schutte et al. | 104/129 |
| 7,913,627 | B2 * | 3/2011 | Shimizu et al. | 104/129 |

FOREIGN PATENT DOCUMENTS

| | | | |
|---|---|---|---|
| DE | 19816768 | A1 | 11/1999 |
| DE | 10042597 | C1 | 1/2002 |
| DE | 10160039 | C1 | 9/2003 |
| EP | 1378277 | A1 | 1/2004 |
| JP | 63-112373 | * | 5/1988 |
| WO | 03009914 | A1 | 2/2003 |

* cited by examiner

*Primary Examiner* — Mark Le
(74) *Attorney, Agent, or Firm* — Kilpatrick Townsend & Stockton LLP

(57) ABSTRACT

A roller coaster ride system comprising a first track section which is adapted to guide a passenger car and a second track section which extends in a first plane. The roller coaster ride system is characterized in that the second track section is attached to a platform which is moveably guided on a frame in a second plane that is inclined in relation to the first plane, in particular perpendicular thereto, and that the second track section can be coupled in a first position to the first track section in order to transfer a passenger car from the first track section to the second track section, and can be in a second position is spatially offset along the second plane relative to the first position.

10 Claims, 11 Drawing Sheets

ROLLER COASTER RIDE ELEMENT WITH MOVEMENT IN A SECOND DRIVING DIRECTION

CROSS-REFERENCE TO RELATED APPLICATIONS

This application claims the benefit of priority of European Application No. 11 171 472.1, filed Jun. 27, 2011, the disclosure of which is herein incorporated by reference.

BACKGROUND OF THE INVENTION

The invention relates to a roller coaster ride system comprising a first track section which is adapted to guide a passenger car and a second track section which extends in a first plane. Another aspect of the invention is a method for operating a roller coaster ride.

Roller coaster rides are used to entertain passengers by exposing them to a mixture of acceleration, speed and sensation of height. Different variants in respect of passenger placement, positioning and harnessing are commonly used in designing such roller coaster rides. The passengers are usually arranged in a passenger car and securely restrained from falling out, and such a passenger car may be designed as a single-passenger car or as a car for several passengers, and may be guided by rails disposed laterally, above, or below the passenger car, or by a combination of such rails. Moving the passengers in such roller coaster rides in different roller coaster ride systems, for example accelerating them on track sections that are inclined relative to the horizontal plane so that the passengers gain a feeling of weightlessness, is well known, and moving the passengers in loopings and tight curves in order to reach high levels of acceleration is also well known.

BRIEF SUMMARY OF THE INVENTION

In contrast to these prior art roller coaster rides, the object of the invention is provide a roller coaster ride system which delivers an entertainment value that is more surprising for the passengers.

This object is achieved, according to the invention, by fixing the second track section to a platform which is moveably guided on a frame in a second plane that is inclined in relation to the first plane, and in that the second track section can be coupled in a first position to the first track section in order to transfer a passenger car from the first track section to the second track section, and in a second position is spatially offset along the second plane relative to the first position.

With the roller coaster ride system according to the invention, a new effect and entertainment value for passengers is provided that consists in a movement perpendicular to the rail path, for example a movement of the passenger car vertically downwards that is produced by moving the passenger car along with the track section on which the passenger car is situated. As a result, a totally new form of movement is achieved in a roller coaster ride system, namely one that engenders a new kind of sensation in the passenger and which also provides additional entertainment value due to a surprise effect. More specifically, according to the invention, the second track section may be horizontally aligned, as a result of which an element surprise can be engendered for the passenger by creating the impression of a slanting or perpendicular drop, which has a high entertainment value.

According to the invention, for example, the passenger car may be guided from a first track section to a horizontally oriented second track section, then fixed on this second track section with regard to its horizontal mobility along the second track section, in order to then be moved along with the latter track section, in particular to be dropped vertically. A sensation of falling can be created by providing a free fall in one section of track, in order to then brake the passenger car along with the second track section and to bring it to a standstill on a second, lower position. From this second position, the passenger car can then be driven out of the second track section onto a third track section, or it could alternatively be raised again along with the second track section in order to drive the passenger car at a higher position compared to this lowered position, back out from the second track section onto a third track section, or back onto the first track section if the second track section is raised as far as the first height. As an alternative, the passenger car could also be moved by raising and then lowering the passenger car along with the second track section. With the roller coaster ride system according to the invention, a specific entertainment component is thus provided that can be implemented either by retrofitting existing roller coaster rides, or which more particularly, however, can be integrated as a characteristic feature in the overall ride provided by a new roller coaster ride.

The platform can be guided along a second plane on a straight or curved track. The crucial aspect for the experience engendered by the invention is that the direction of movement of the platform with the second track section is in a different direction to the direction in which the second track section itself extends. This can be an inclined plane to the perpendicular, a straight track, a curved track or a combination of such movements.

For movement along the second plane, the passenger car may be at a standstill on the second track section. Alternatively, the passenger car may move along the second track section during movement along the second plane, thus resulting in a totally surprising component of movement for the passengers in a direction that differs from that of the rail track. In this case, the passenger car moves on a path of movement composed of two superimposed movements, which may be a path of movement similar to a parabola, for example.

According to a first preferred embodiment, the second position is offset relative to the first position by at least one meter, preferably by more than three meters and in particular by more than five meters. The offset preferably consists of a drop in height in the perpendicular or inclined direction. Offsetting or lowering the passenger car by this distance allows the passenger to be given an entertaining impression of free fall, while at the same providing sufficient vertical tracks to retard the passenger car out of the free fall again, without any levels of acceleration harmful to health occurring. For example, the passenger car along with the second track section and platform may drop by approximately 5.5 meters, which takes approximately 1.6 seconds. In the case of such a drop, the first two meters may then be carried out as an ideal free fall in exactly the vertical direction, with braking out of this free fall occurring on the following 3.5 meters. The critical factor for conveying an ideal impression of free fall is that the platform, the passenger car and the second track section be guided in a purely vertical direction during the free fall, for example by lateral guide wheels on a vertical rail, but that preferably no protective measures, such as safety cables or the like, need to be transported at the same time and accelerated accordingly.

It is further preferred that the roller coaster ride system be developed by including a holding device which is adapted to hold die platform in an upper position, preferably in the first position, and which can be actuated in order to release the platform from said upper position for free fall. By means of such a holding device, it becomes possible to hold the platform at the first height in the initial position, on the one hand, and on the other hand to release the platform abruptly from this first height and thus to trigger the free fall.

More particularly, the holding device may comprise a permanent magnetic holding device which is preferably in the form of a holding member which can be magnetised and which is attached to the platform, as well as a magnet attached to the frame, preferably a bistable electropermanent magnet. With this development of the invention, a low-wear yet reliably holding and spontaneously triggerable means for holding and fixing the platform is provided. In particular, it is possible with a bistable electropermanent magnet to provide a safe and reliable holding device that has no noticeable effect on the passengers' impression of falling. Such a bistable electropermanent magnet has two stable states in which no power supply is needed. The one stable state generates a holding force on account of its polarity, whereas the other state causes release and even a brief active detachment or repulsion due to its specific polarity. By providing a brief supply of current, for example for a duration of approximately one second, a reversal of polarity and thus a switch between the two stable states is produced. The advantage and crucial safety aspect of such a bistable electropermanent magnet is that it does not require a supply of current for the holding force itself, and instead only needs a pulse of current in order to reverse polarity in a polarity reversal phase, said pulse switching it from the one polarity state to the other polarity state, and back to the first polarity state by means of a second pulse of current.

It is also preferred that the roller coaster ride system be developed by providing a safety coupling mechanism disposed between the platform and the vertical guidance mechanism for detachable, form-locking coupling in the first position, and a load gauge for measuring the holding force of the holding device. By means of this safety coupling mechanism, and the simultaneous measurement of forces by means of the load gauge, which may be in the form of one or several force measurement bolts, for example, it is possible to establish in a reliable and constructional simple manner whether the platform is being held reliably in the first position by the holding device. This is characterised by the load gauge measuring a holding force in the holding device that is greater than the weight force of the platform and the passenger car when the holding device is holding reliably. It should be understood in this regard that this holding device and load gauge may be in signal communication with an electronic controller in such a way that, in one operating state in which a respective holding force is detected by the load gauge, clearance is given for the rest of the drop. If no holding force or too small a holding force is measured, a check indication, for example, may be emitted in such an operating state, prompting the operator of the roller coaster ride to check the functional operation of the holding device. The control device may also be configured, in the case of normal operation, i.e. when a specific holding force is measured, to disengage the safety coupling mechanism from its positive engagement shortly before the drop is triggered, so that the platform can then be held by the holding device and can be released for free fall. For example, the safety coupling mechanism may be in the form of moveable bolts which engage in elongate holes on the platform with a slight amount of play that prevents force being absorbed by the bolts when the holding device is functioning properly, and which ensures that the platform is secured and held by the bolts after a brief drop in the event of holding device failure.

The roller coaster ride system according to the invention may be developed by providing a third track section which is preferably at a height below the height of the first track section and which is adapted to guide the passenger car and which can be coupled to the second track section in order to transfer the passenger car from the second track section to the third track section. This development results in the free falling experience for the passengers in a roller coaster ride system being integrated in a favourable manner, in that the passenger car is driven into the drop mechanism from a rail guide at a first height, then allowed to drop to a second height and then driven out of the drop mechanism again at the second height onto a rail guide provided at that second height, in order to be supplied for another roller coaster ride, for example. In particular, a change of passenger may be carried out in first position or in the second position, so that the experience of falling occurs for passengers at the beginning or at the end of the ride. It should be understood, as a basic principle, that not only the first track section but also the second and third track section are preferably horizontal in orientation, i.e. do not have any inclination, or any significant inclination.

According to another preferred embodiment, the inventive roller coaster ride system is characterised by a brake mechanism for slowing the platform from a free fall. Such a brake mechanism is advantageous, especially when the platform is moved in free fall in a first drop phase, in order to then brake the platform in a safe and reliable manner.

The brake mechanism may comprise, more specifically, a linear eddy current brake which is preferably in the form of permanent magnetic bars that are fixed to the platform and which co-operate with reaction plates fixed to the frame. Such a linear eddy current brake should be understood as an arrangement of longitudinally extending reaction plates in which a braking current is induced by permanent magnets being moved accordingly. The inventive mechanism preferably has four such linear eddy current brake portions spaced apart from each other, in particular at the four corners of the second track section, wherein each individual linear eddy current brake portion may have a plurality of reaction plates arranged parallel to each other and which co-operate with a corresponding plurality of permanent magnets arranged parallel to each other. Such a linear eddy current brake provides wear-free and safe braking of the platform from a high speed to a low speed and at the same time involves simple circuitry, since such an eddy current brake does not require any kind of actuation or releasing. It should be understood in this regard that the characteristic of eddy current brakes, namely that they exert strong braking forces at high speeds and weak braking forces at low speeds, is advantageous here because the high dropping speed can be reliably reduced in this way, whereas no significant amount of resistance is exerted by the brake mechanism when the platform is slowly raised again from the lowered position.

It is still further preferred that the brake mechanism includes one or more hydraulic shock absorbers which are preferably disposed and dimensioned such that they brake the platform to a standstill on a drop distance which is preceded by braking by means of an eddy current brake. By means of such a hydraulic shock absorber, a redundant brake mechanism can be provided that on the one hand protects against levels of acceleration harmful to health, and on the other hand a brake mechanism element that can brake to a standstill. It is particularly preferred in this regard that this hydraulic brake mechanism be combined with an eddy current brake mechanism, said combination preferably being designed in such a way that the platform is initially braked by means of an eddy current brake from a high speed to a low speed and then further braked by means of the hydraulic shock absorber brake mechanism from this low speed to a standstill. The eddy current brake therefore acts before the hydraulic brake, although this does not exclude the possibility that the eddy current brake can continue to act over the distance that the hydraulic shock absorber device acts.

It is still further preferred that the platform and the frame co-operate in such a way that the second track section is guided in free fall from the first to the second position on a first track section and is braked on a second track section out of free fall to a standstill by means of a brake mechanism, wherein the first track section preferably has a length of 20% to 50% of the distance between the first and the second position. Splitting the downward vertical movement of the platform into a free fall phase and a braking phase results in a particularly good entertainment effect on the passengers and at the same time in safe braking from free fall. Splitting the vertical distance into approximately 20 to 50% free fall and approximately 50 to 80% braking distance, accordingly, is advantageous for achieving a surprising dropping effect long enough to be well perceived, while also providing a sufficient braking distance with room for redundant brake mechanisms.

It is still further preferred that the inventive roller coaster ride system be developed by including a first coupling device for aligningly coupling the first and second track sections in the first position and/or a second coupling device for aligningly coupling the third and second track sections in the second position. It should be understood as a basic principle that the impression of a surprising and genuine free fall of the passenger car can be achieved above all by the passenger car being guided during such free fall in a way that is barely perceptible or imperceptible, as far as possible. However, this also and specifically entails that, because of this barely perceptible guidance, exact positioning of the track sections in relation to each other cannot be achieved by the guidance device alone. A coupling device is therefore important for the ride with regard to both the impression it creates on passengers and also with regard to its functional reliability, in order to achieve safe and reliable transfer of the passenger car between the first, second and third track sections by appropriate additional coupling and alignment. It should be understood in this regard that a respective safety coupling mechanism may be in signal communication with the first and second coupling device, said coupling mechanism preventing a platform drop or lifting operation being triggered when the first and second track sections or the second and third track sections are coupled.

Finally, it is still further preferred that the roller coaster ride system be developed by including a lifting device comprising a lifting adapter which is adapted to be connected to the platform in order to raise the platform from the second to the first position and which is adapted to be separated from the platform in order to lower the lifting adapter from the first to the second position separately from the platform. Such a lifting device is characterised in that it can lift the platform by coupling a lifting adapter, but can lower the lifting adapter independently of the platform, which means that the lifting adapter itself and all the lifting members of the lifting device do not have to be moved when the platform is being lowered, and particularly when the platform is in free fall. This also intensifies the sensation experienced by the passengers, since the number of parts moved during the drop can be further reduced in this way. For example, the lifting device may be implemented in the form of cables and pulley reducers. Two or more actuators in the form of electric motors in signal or mechanical communication with each other may be used in this connection to obtain synchronous lifting.

The roller coaster ride system according to the invention can preferably be operated according to a method for operating a roller coaster ride, said method comprising the steps of moving a passenger car from a first track section onto a second track section which is in a first plane, and moving the passenger car with the second track section in a second plane which is inclined, in particular perpendicular to the first plane, in particular vertically lowering the passenger car with the second track section by at least one, and preferably three meters. Applying such a method gives rise to a novel, surprising and entertaining sensation among passengers on the ride.

The method can be developed by dropping the passenger car in free fall in a first lowering phase and then braking it from free fall in a subsequent second lowering phase.

It is also preferred that that the passenger car is braked from free fall by means of an eddy current brake and/or by hydraulic cushioning. It is also possible to carry out a sequence of free falls and braking.

It may also be preferred, finally, that the passenger car be raised by means of a lifting device from the second height to the first height, where it is held by a holding device, preferably by a holding device in the form of bistable electropermanent magnet, and that the lifting device be subsequently lowered without the passenger car to a height below the second height.

With regard to the details, advantages and alternative embodiments of the method and preferred embodiments described in the foregoing, reference is made to the corresponding embodiments of the roller coaster ride according to the invention and to the descriptions provided in the foregoing.

A preferred embodiment of the invention shall now be described with reference to the Figures.

BRIEF DESCRIPTION OF THE DRAWINGS

FIG. 9 shows a view according to FIG. 1, in a fifth operating position with passenger cars driving in.

DETAILED DESCRIPTION OF THE INVENTION

Figure 1:
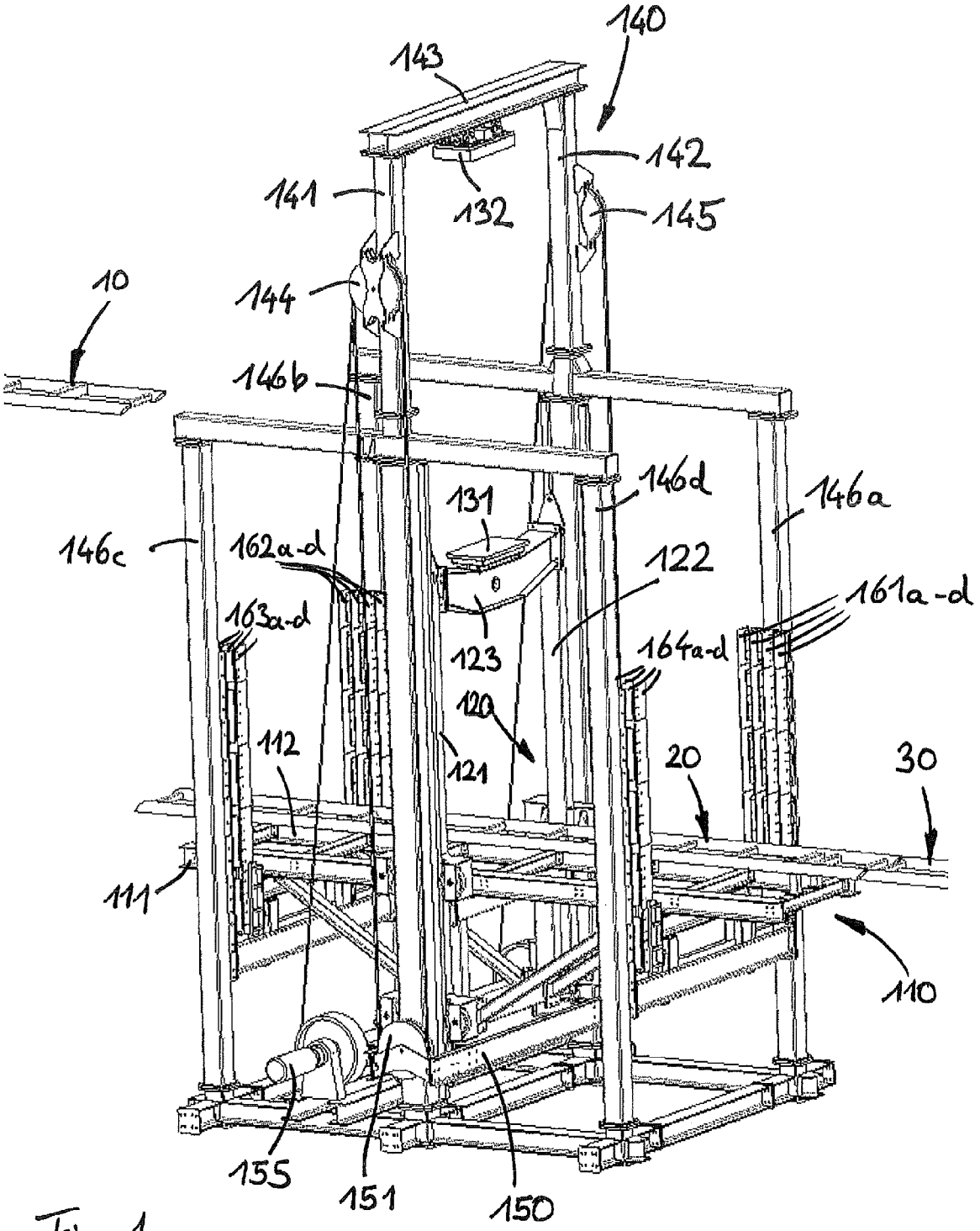
FIG. 1 shows a perspective schematic view of the roller coaster ride according to the invention in a first operating position.

As can be seen from FIG. 1, the funfair ride according to the invention comprises a first track section (10), a second track section (20) and a third track section (30).

In the view shown in FIG. 1, the second track section 20 is coupled aligningly to the third track section 30.

The second track section 20 is attached to a drop platform (100) which mainly comprises a horizontal frame 110 underneath the second track section and a vertical guidance frame 120. Horizontal frame 110 is constructed in the manner of a ladder frame and substantially comprises two horizontal struts 111, 112 and a plurality of transverse struts connecting the latter horizontally.

The vertically oriented guidance frame 120 comprises two vertical frame profiles 121, 122 which run laterally and perpendicularly to the second track section and an upper, horizontal platform retaining bridge 123. A retaining plate 131 having a horizontal upwardly facing surface is fixed to platform retaining bridge 123.

Figure 2:
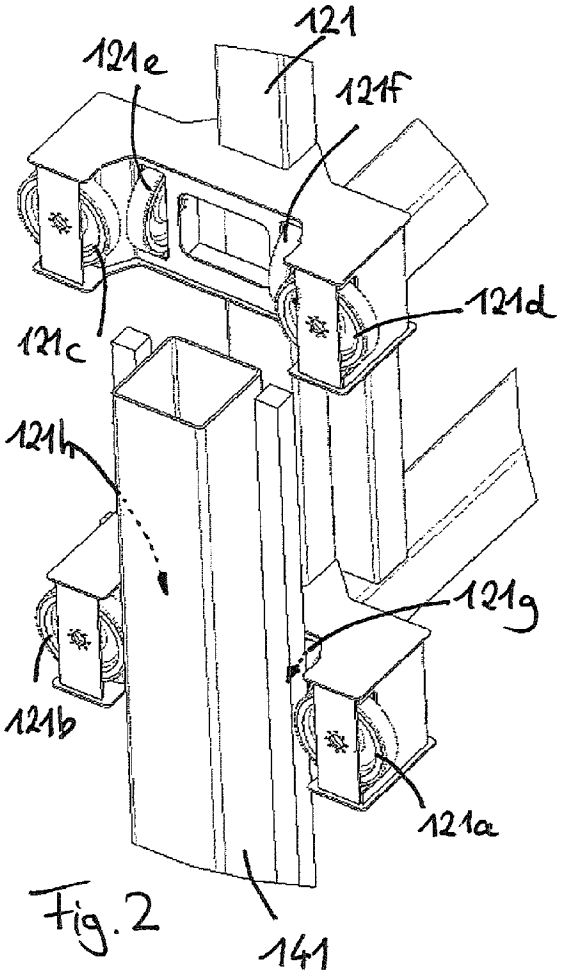
FIG. 2 shows a first detailed view of the roller coaster ride system according to the invention.

As it can be seen in greater detail in FIG. 2, drop platform 120 is guided in a vertical direction along two lateral vertical struts 141, 142 by means of eight rollers 121*a-h*, 122*a-h* on either side. These rollers 121*a-h*, 122*a-h* ensure that the drop platform moves in free fall in a direction that is exactly perpendicular.

Vertical guide struts 141, 142 are provided on a frame 140 which entirely surrounds the drop platform laterally. This frame is attached in a stable manner to a plurality of horizontal foundation struts by a plurality of vertical struts and diagonal struts. The frame is anchored on a bottom plate or respective foundations by means of these foundation struts.

Figure 3:
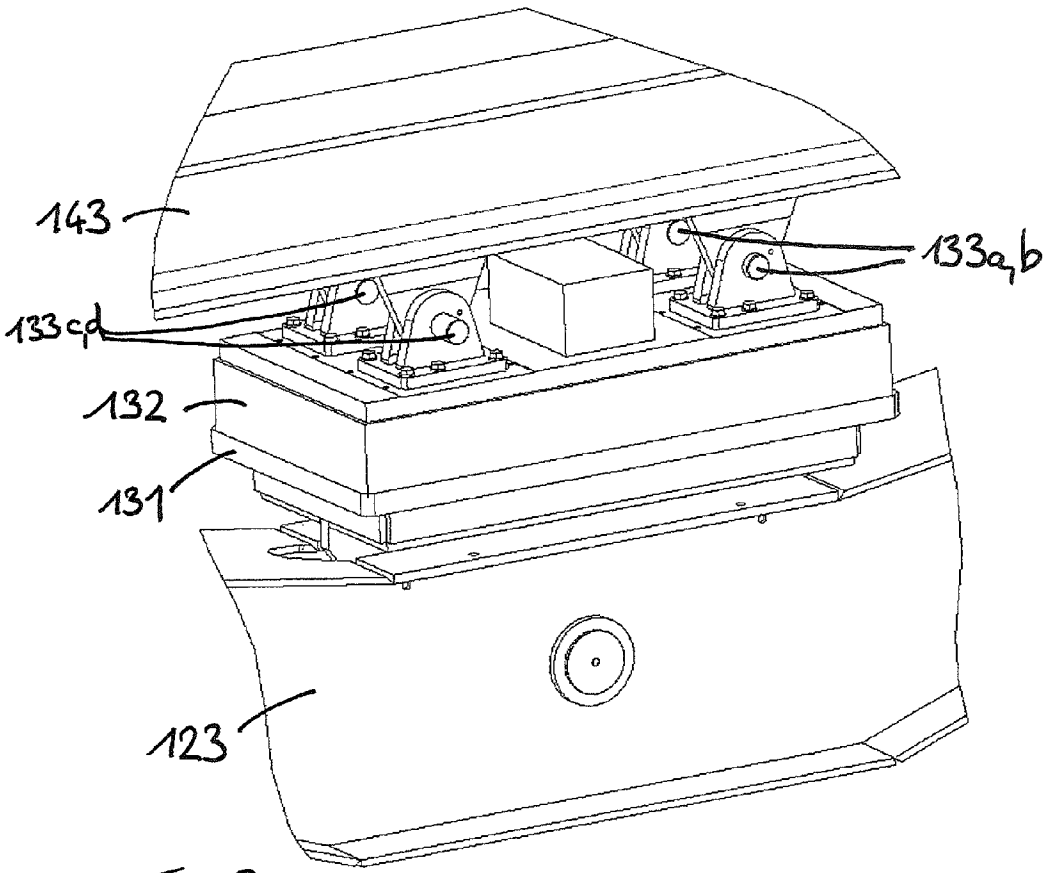
FIG. 3 shows a second detailed view of the roller coaster ride system according to the invention.

Vertical guide struts 141, 142 extend as far as an upper end and are connected to each other at said upper end by means of an upper strut frame bridge 143. As it is shown in greater detail in FIG. 3, a bistable electropermanent magnet 132, positioned in such a way that retaining plate 131 co-operates in the upper first position with said electropermanent magnet and docks onto the latter, is fixed to the upper strut frame bridge. The bistable electropermanent magnet is fixed to the upper strut frame bridge 143 using two pairs of coaxial bolts 133*a-d*. One pair of said bolts (133*a,b*) is provided in the form of a pair of force measurement bolts and thus measures half of the weight force held by the electropermanent magnet.

Two safety bolts are also disposed on the underside of the upper strut frame bridge (not visible), which can be actuated by means of an actuator to engage in two elongate holes in the vertical guidance frame. In a drop platform position maintained by the electropermanent magnet, these safety bolts have a degree of play within the elongate holes and for that reason do not absorb any force which might falsify measurement by the force measurement bolts. In the event of failure on the part of the electropermanent magnet, the drop platform falls a few millimeters within the scope of this play, for example by 1-10 mm downwards and is then held by the safety bolts.

A lifting beam 150 is disposed underneath drop platform 120. This lifting beam is likewise mounted moveably in the vertical direction on vertical guide struts 141, 142. Lifting beam 150 can be raised by means of two laterally disposed pulleys 151, 152, over which cables are guided which run, in turn, over pulleys 144, 145 disposed further above in the region of the upper strut frame bridge 143 and which are fixed to vertical guide struts 141, 142. The cables are wound onto or wound off electromotive winches 155, 156 in order to raise or lower lifting beam 150, accordingly.

Figure 4:
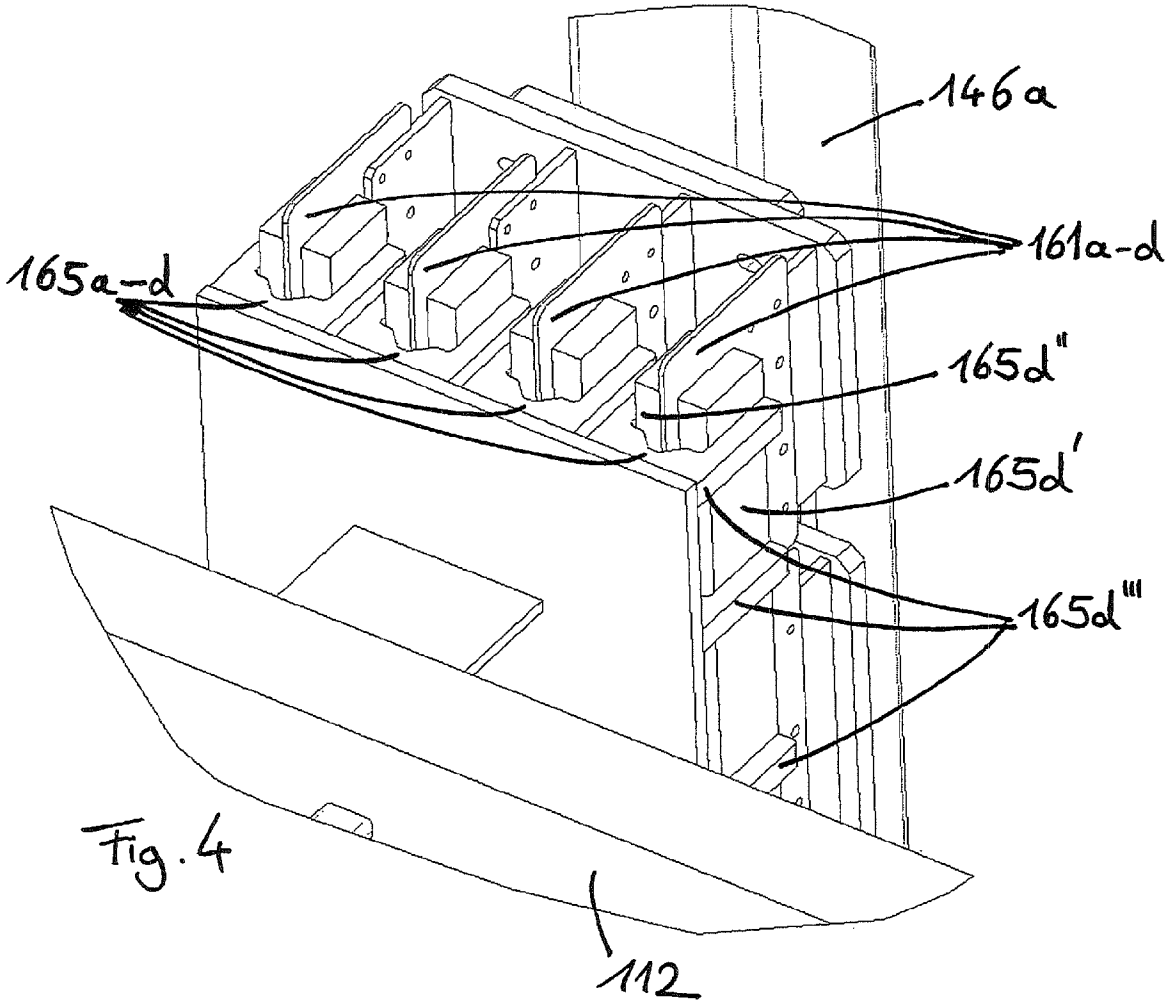
FIG. 4 shows a third detailed view of the roller coaster ride system according to the invention.

In addition, vertically extending brake fins 161-164*a-d* made of a copper alloy, and which can be seen in greater detail in FIG. 4, are disposed on each of four lateral vertical struts 146*a-d* on frame 140. The brake fins act as reaction plates. Four brake fins, which extend over a portion of the vertical distance between the first track section 10 and the third track section 30, are disposed on each vertical frame strut 146*a-d*.

Permanent magnets 165-168*a-d* co-operate with these brake fins 161-164*a-d*, each permanent magnet being composed of two opposite pole shoes 165*d*", 165*d*" engaging with the brake fins and a plurality of yokes 165*d*"' connecting said pole shoes. These permanent magnets are attached, facing the brake fins, to horizontal struts 111, 112 at four corners, and are provided in respective engagement with and in corresponding number to brake fins 161-164*a-d*. This arrangement of brake fins and permanent magnets provides a linear eddy current brake for braking the vertical movement of the drop platform relative to the frame.

In FIG. 1, the drop platform is shown in the lower position and the second track section is aligningly coupled to the third track section such that a passenger car (not shown) can move from the drop platform onto the third track section.

Figure 6:
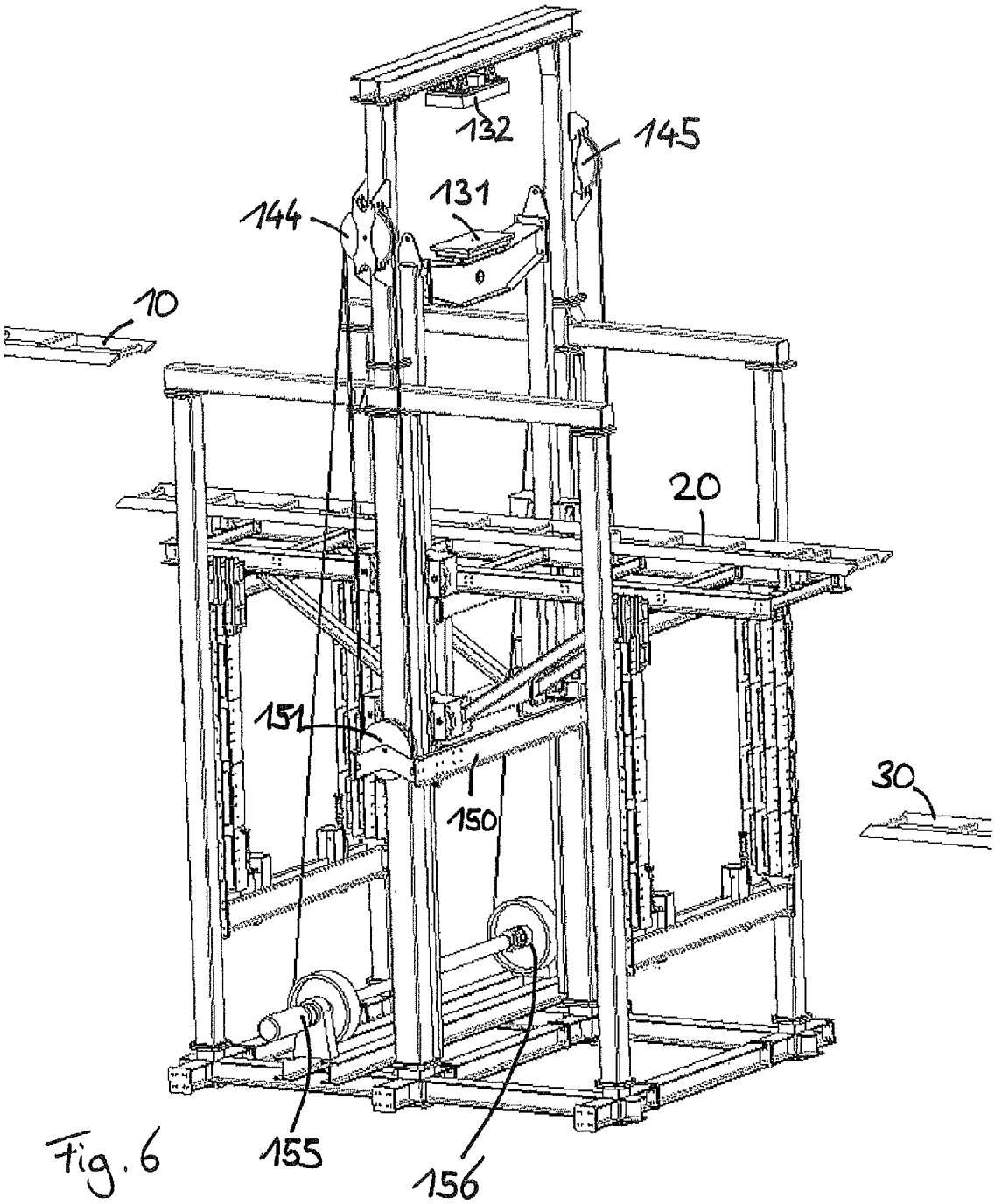
FIG. 6 shows a view according to FIG. 1, in a second operating position.

FIG. 6 shows the inventive funfair ride in an operating state that follows FIG. 1. In this second operating state, the drop platform is raised by operating electric winches 155, 156, and lifting beam 150 is raised as a result along vertical guide struts 141, 142.

Figure 7:
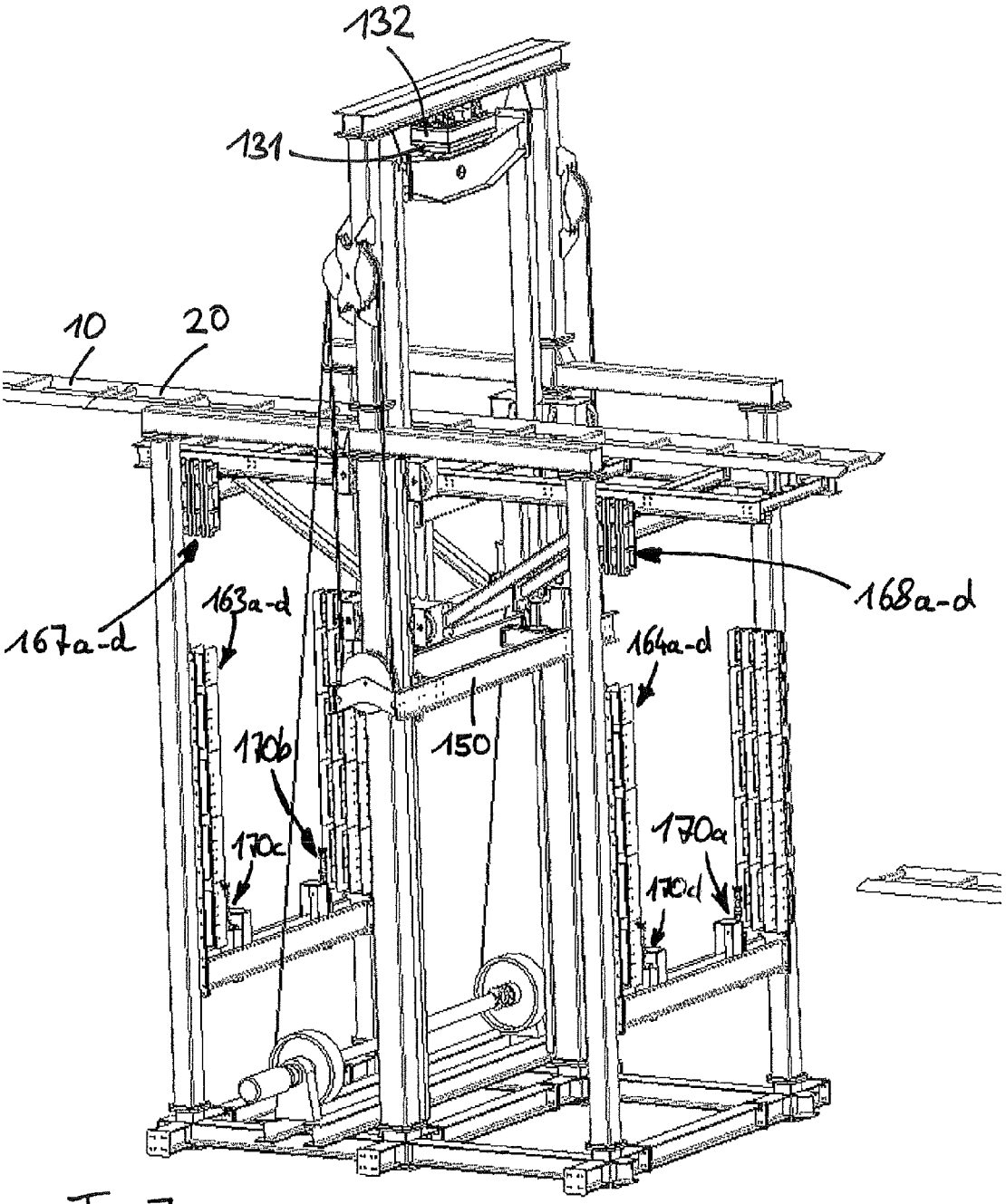
FIG. 7 shows a view according to FIG. 1, in a third operating position.

FIG. 7 shows an operating position that follows FIG. 6, in which drop platform 120 has been raised to the maximum height. At this maximum height, retaining plate 131 and the bistable electropermanent magnet 132 co-operate, the latter having been switched for this purpose to a polarity which produces a magnetic holding force between the upper retaining bridge 143 of the frame and the crossbar 123 of the drop platform.

In this operating position, a force measurement bolt is inserted form-lockingly between the frame and the electropermanent magnet in order to redundantly secure the drop platform in this raised position.

Figure 8:
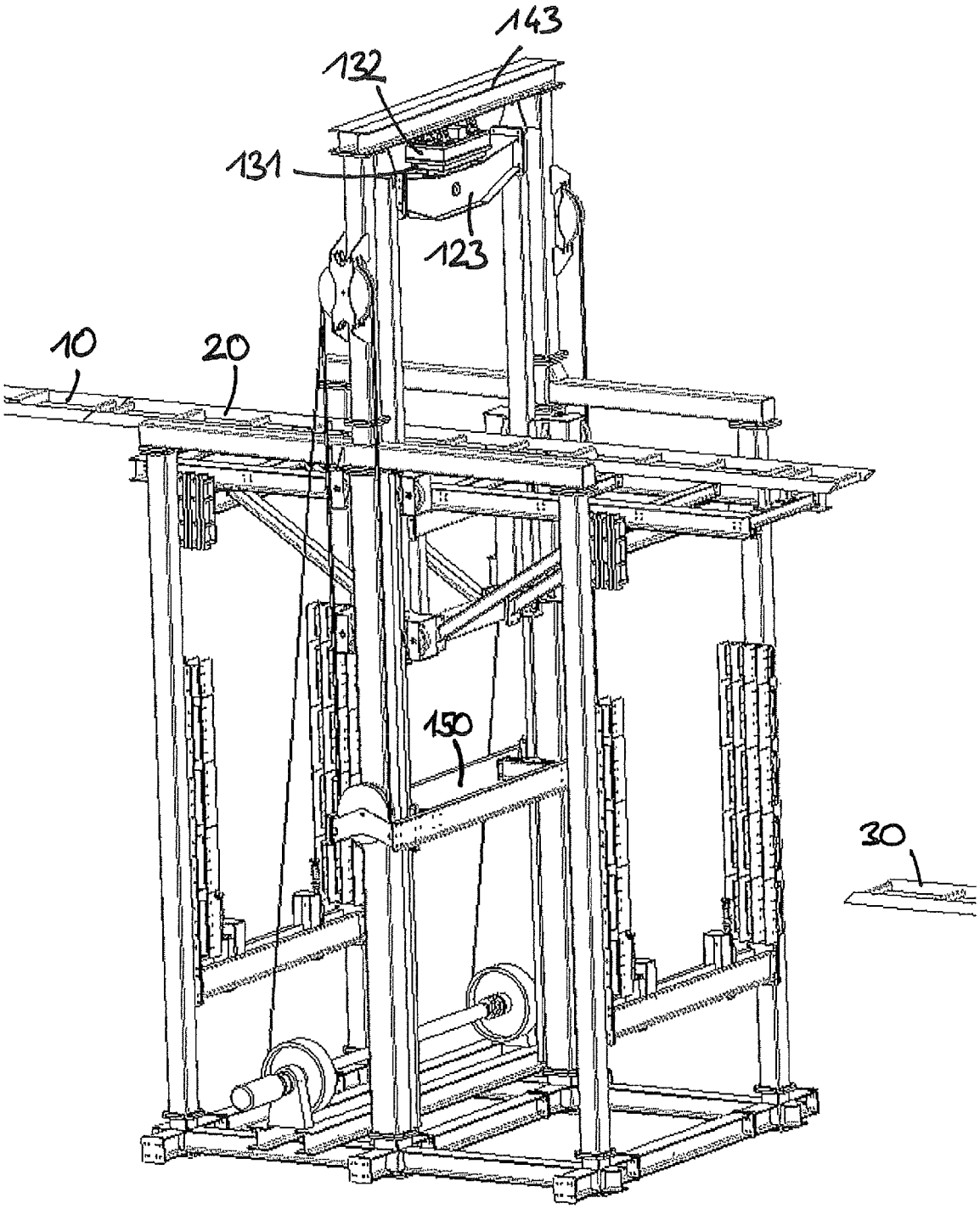
FIG. 8 shows a view according to FIG. 1, in a fourth operating position.

FIG. 8 shows the funfair ride in an operating position that follows FIG. 7 and in which lifting beam 150 is lowered again by actuation of electric winches 155, 156. The drop platform is held in the raised position by the holding force of the bistable electropermanent magnet 132. If this bistable electropermanent magnet is operating normally, a force is measured in this operating position by force measurement bolts 133*a, b* that correlates to the weight of the drop platform. If this is established by the electronic control device, the first and second track sections are coupled together aligningly by a coupling device and a passenger car can drive in.

Figure 9:
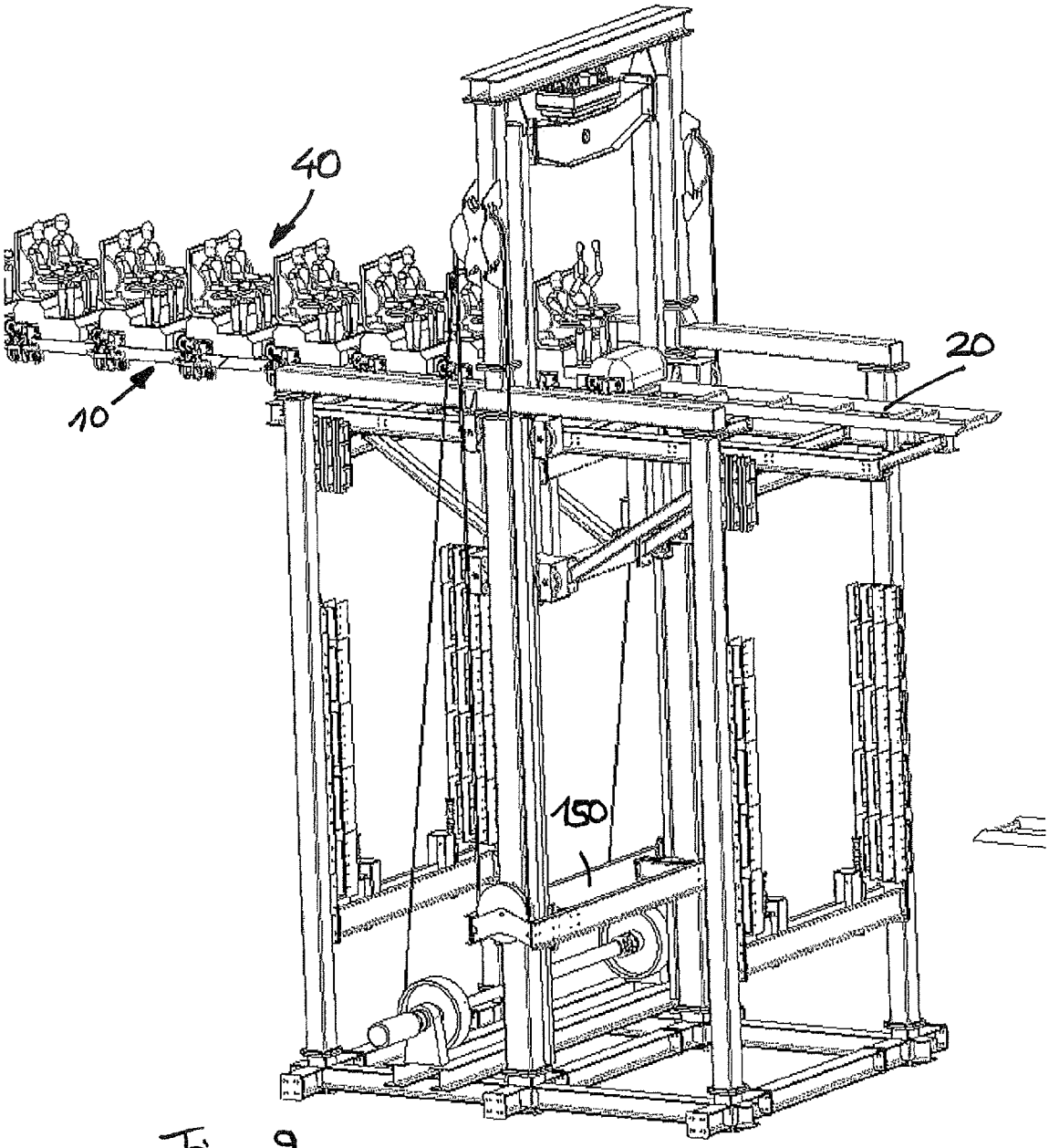

FIG. 9 shows this passenger car 40 occupied by passengers driving from the first track section 10 onto the second track section 20. Lifting beam 150 is lowered still further while the passenger car drives in.

Figure 10:
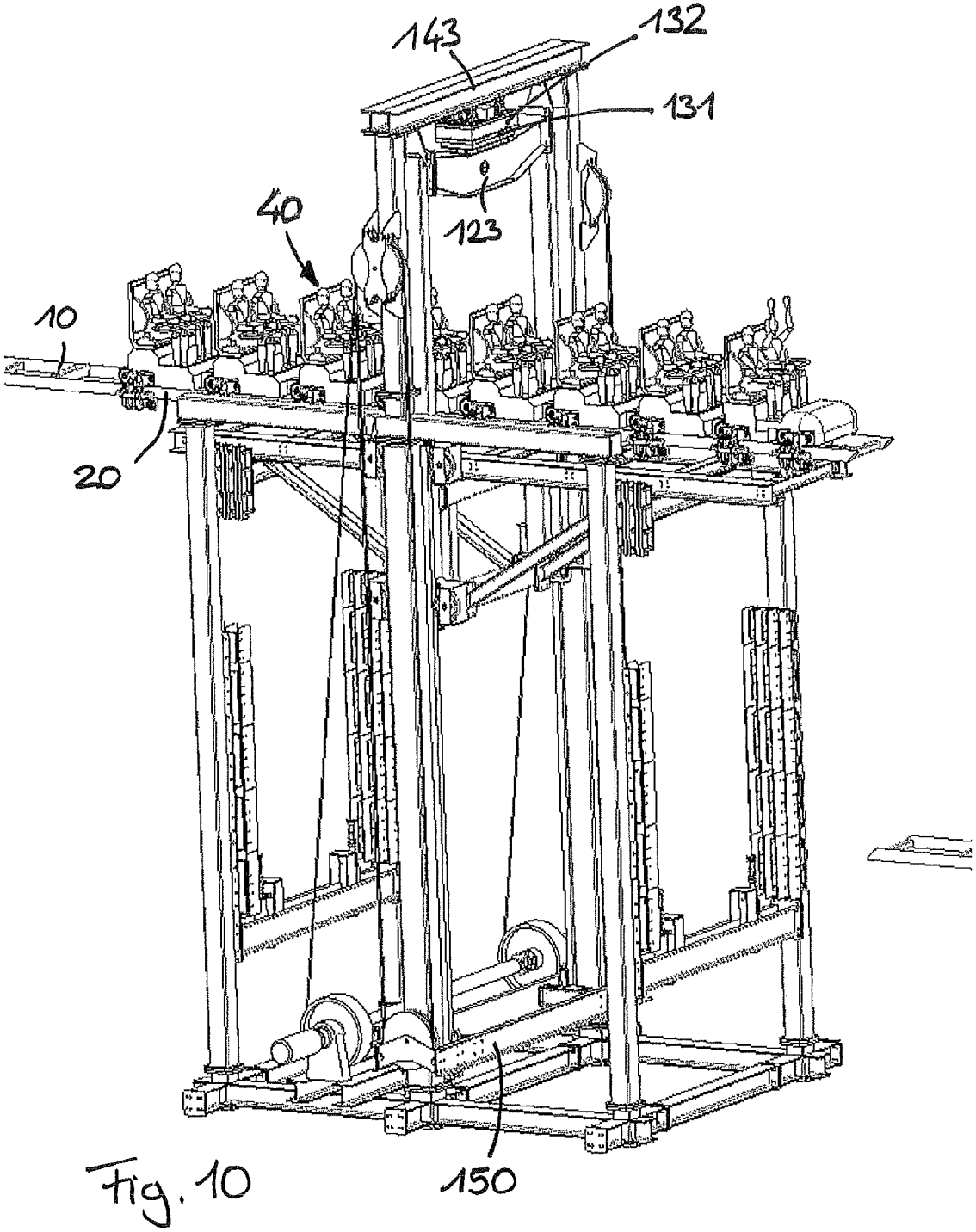
FIG. 10 shows a view according to FIG. 1, in a sixth operating position.

FIG. 10 shows an operating position that follows FIG. 9, in which the passenger car has driven onto the second track section and has come to a standstill thereon. Lifting beam 150 is now at its bottommost position, which is underneath a position in which contact occurs between the drop platform in its bottommost position and lifting beam 150. When the drop platform is in this operating position, a check is performed once more to determine whether force measurement bolts 133*a, b* are detecting a force, since electropermanent magnet 132 now has to bear the weight of the passenger car and of the passengers in addition. If the force measurement bolts also measure a corresponding force in this operating position, the ride is cleared for the rest of the sequence.

Figure 11:
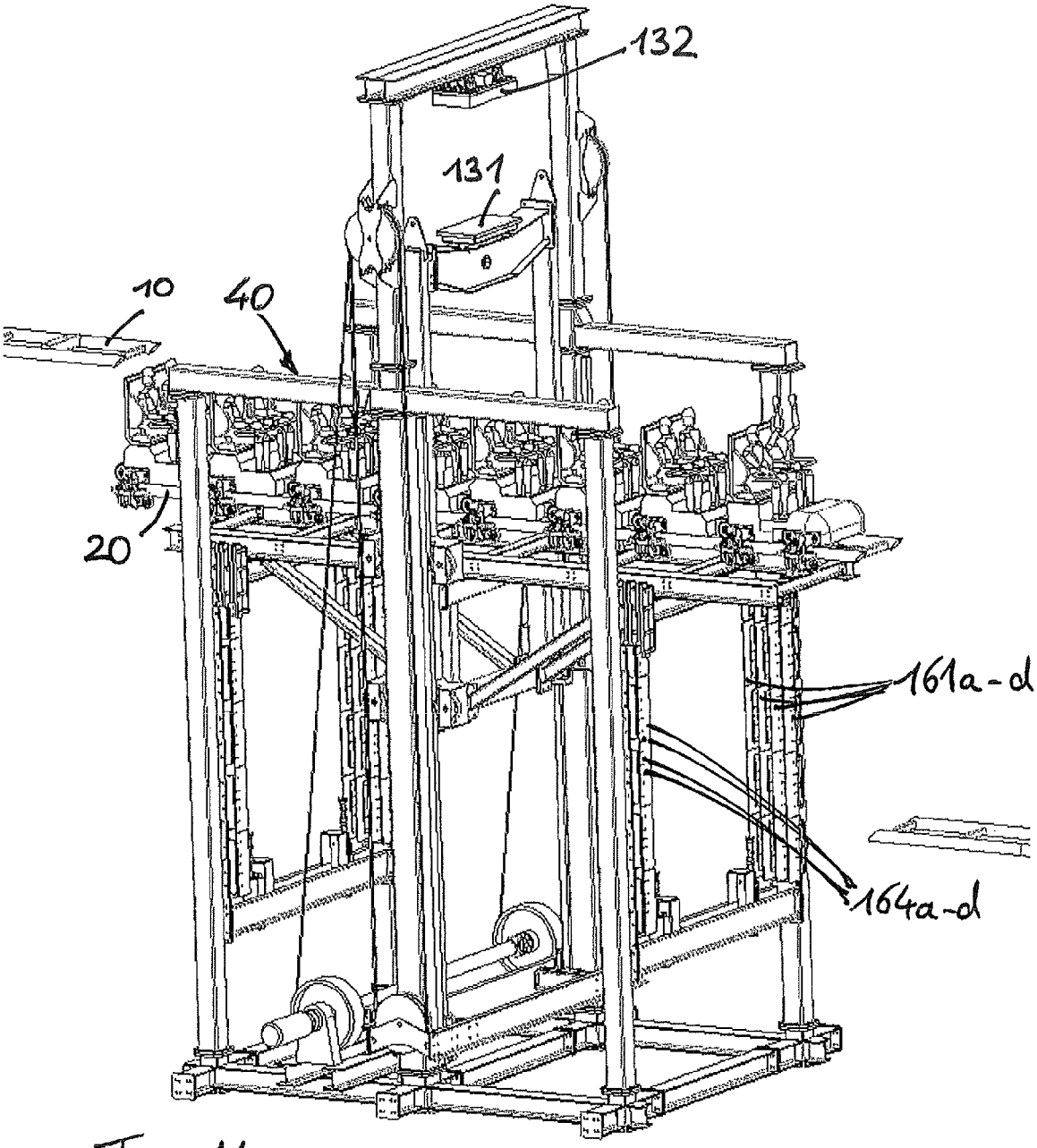
FIG. 11 shows a view according to FIG. 1, in a seventh operating position.

FIG. 11 shows the ride shortly after the drop has been triggered. The drop is triggered by briefly applying a pulse of current to the bistable electropermanent magnet 132, thus reversing its polarity. The holding force exerted by the bistable electropermanent magnet 132 is released as a result and drop platform 120 falls downwards in free fall, along with passenger car 40 and the passengers fixed thereto by means of appropriate safety coupling mechanisms. FIG. 11 shows this dropping movement in free fall shortly before the braking effect is exerted by the linear eddy current brake. It can be seen that eddy current coils 165-168*a-d* have not yet engaged the vertically extending brake fins 161-164*a-d*.

Figure 5:
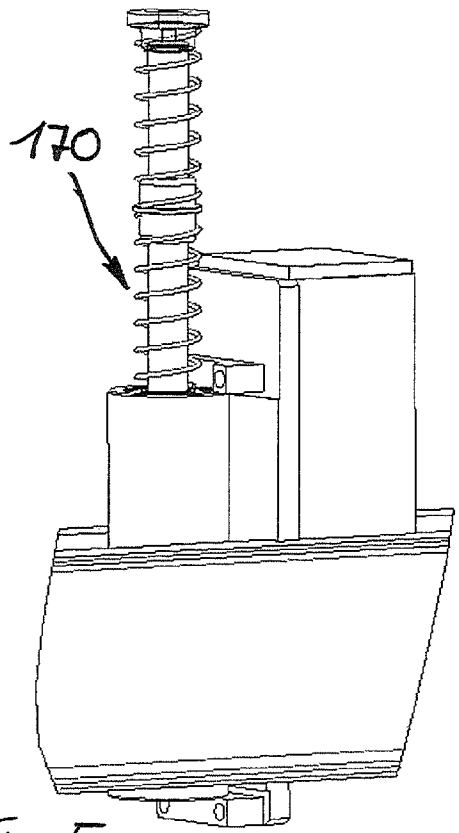
FIG. 5 shows a fourth detailed view of the roller coaster ride system according to the invention.
Figure 12:
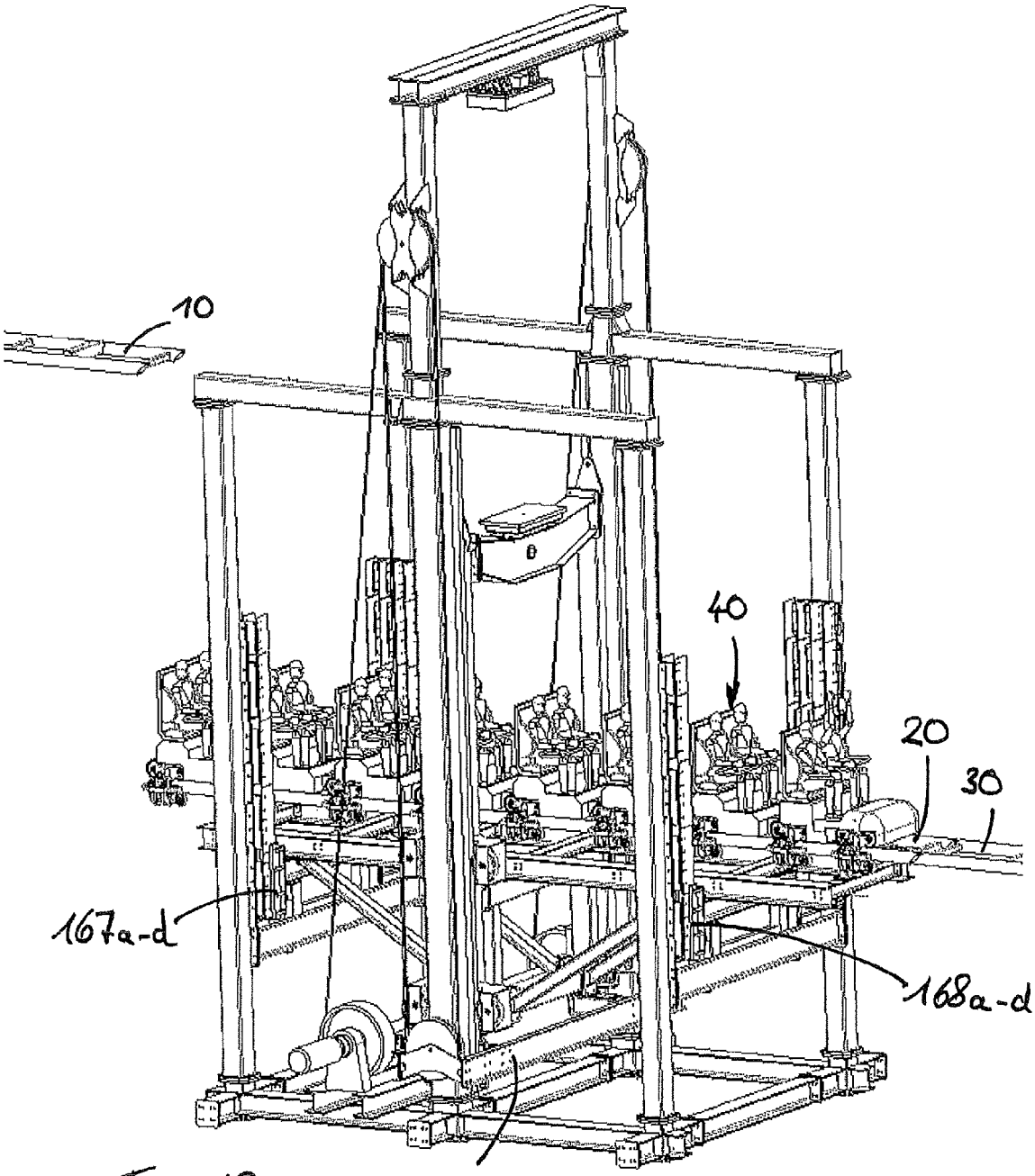
FIG. 12 shows a view according to FIG. 1, in an eighth operating position.

FIG. 12 shows the inventive funfair ride in a lowered position after the free fall has been braked. This braking is initially performed by linear eddy current brakes 160-168 alone over a distance of about 2.5 meters, after which braking is performed over a distance of about 0.5 meters, during which the linear eddy current brakes act together with four spring-biased hydraulic shock absorbers 170*a-d*, shown in detail in FIG. 5, and brake drop platform 120 from its reduced speed to a standstill at a lowermost position. In this lowermost position, drop platform 120 has no contact with lifting beam 150.

Figure 13:
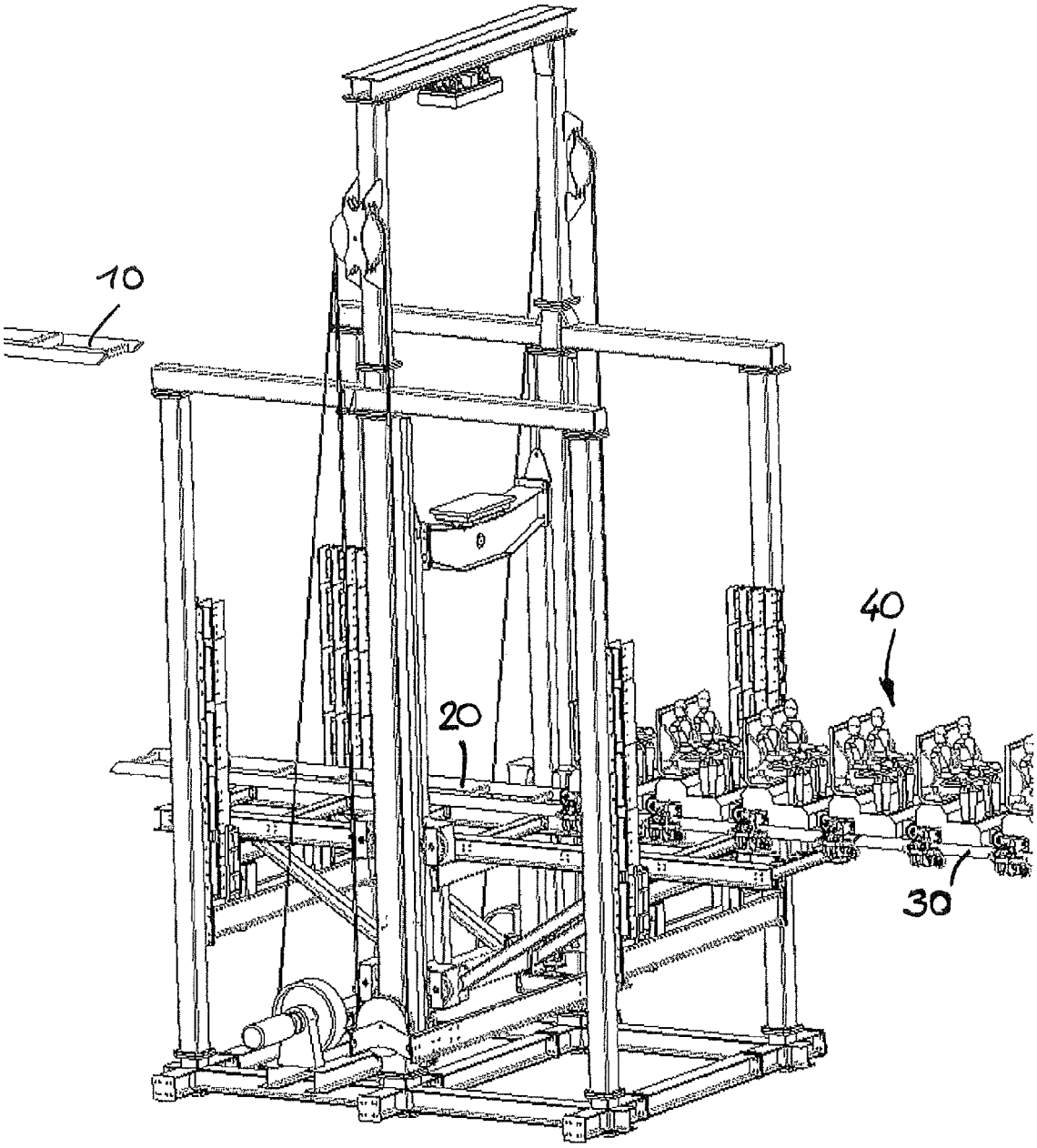
FIG. 13 shows a view according to FIG. 1, in a ninth operating position with passenger cars driving out.

In FIG. 13, the second track section 20 is subsequently coupled aligningly to the third track section 30 to allow passenger car 40 to drive out and to ensure that it does so. Once the passenger car has driven out, lifting beam 150 can be brought into contact again with drop platform 120 and drop platform 120 can then be raised at suitably reduced speed. During this lifting operation, electric motors 156, 157 have to overcome the weight force of drop platform 120 and of the second track section 20. The braking effect of the eddy current brake, which can be reduced by slowing raising the drop platform, must also be overcome initially for the first 3.5 meters or so.

The invention claimed is:

1. A roller coaster ride system comprising:

a first track section adapted to guide a passenger car, and a second track section which extends in a first plane, characterised in that the second track section is attached to a platform which is moveably guided on a frame in a second plane that is inclined in relation to the first plane, in particular perpendicular thereto, and that the second track section can be coupled in a first position to the first track section in order to transfer a passenger car from the first track section to the second track section, and can be in a second position that is spatially offset along the second plane relative to the first position, and further characterised by a holding device which is adapted to hold the platform in the first position, and which can be actuated in order to release the platform from said first position for free fall.

2. The roller coaster ride element according to claim 1, characterised in that the second position is lowered, relative to the first position by at least one meter.

3. The roller coaster ride system according to claim 1, characterised in that the holding device comprises a magnetic holding device which is in the form of a holding member which can be magnetised and which is attached to the platform, and a magnet attached to the frame.

4. The roller coaster ride system according to claim 1, characterised by a safety coupling mechanism disposed between the platform and a vertical guidance mechanism for detachable, form-locking coupling in the first position, and a load gauge for measuring a holding force of the holding device.

5. The roller coaster ride system according to claim 1, characterised by a third track section which is below a height of the first track section and which is adapted to guide the passenger car and which can be coupled to the second track section in order to transfer the passenger car from the second track section to the third track section.

6. The roller coaster ride system according to claim 1, characterised by a brake mechanism for slowing the platform from a free fall, said brake mechanism comprising a linear eddy current brake which is in the form of permanent magnets that are fixed to the platform and which co-operate with reaction plates fixed to the frame.

7. The roller coaster ride system according to the preceding claim 6, characterised in that the brake mechanism includes a hydraulic shock absorber which is disposed and dimensioned such that the brake mechanism brakes the platform to a standstill on a drop distance which is preceded by braking by means of an eddy current brake.

8. The roller coaster ride system according claim 1, characterised in that the platform and the frame are configured to co-operate in such a way that the second track section is guided in free fall from the first to the second position and is braked out of the free fall to a standstill by means of a brake mechanism, wherein the first track section has a length of 20% to 50% of the distance between the first and the second position.

9. The roller coaster ride system according to claim 1, characterised by a first coupling device for aligningly coupling the first and second track sections in the first position and/or by a second coupling device for aligningly coupling a third track section and the second track section in the second position.

10. The roller coaster ride system according claim 1, characterised by a lifting device comprising a lifting adapter which is adapted to be connected to the platform in order to raise the platform from the second position to the first position and which is adapted to be separated from the platform in order to lower the lifting adapter from the first to the second position separately from the platform.

* * * * *